US006092698A

United States Patent [19]

Bayer

[11] Patent Number: 6,092,698

[45] Date of Patent: Jul. 25, 2000

[54] HIGH VOLUME AEROSOL VALVE

[75] Inventor: Christian Bayer, Armonk, N.Y.

[73] Assignee: Precision Valve Corporation, Yonkers, N.Y.

[21] Appl. No.: 09/281,349

[22] Filed: Mar. 30, 1999

[51] Int. Cl.[7] ..... B65D 83/00

[52] U.S. Cl. ..... 222/402.25; 222/402.1

[58] Field of Search ..... 222/402.1, 402.24, 222/402.25, 402.13

[56] References Cited

U.S. PATENT DOCUMENTS 4,165,825 8/1979 Hansen ..... 222/402.22
4,413,755 11/1983 Brunet ..... 222/402.2

*Primary Examiner*—Steven O. Douglas
*Attorney, Agent, or Firm*—Kilgannon & Steidl

[57] ABSTRACT

A high volume aerosol valve with an axially acting high volume valve stem having upper, intermediate and lower portions. The intermediate portion has an annular gasket sealing groove with four large rectangular orifices having side-to-side vs. top-to-bottom dimensions in a ratio of at least approximately three to one. A stem bore extends from the top of the stem upper portion down through and past the stem intermediate portion and substantially down into the stem lower portion. Narrow web members occupy said stem bore from a position substantially up into said stem upper portion extending down through said stem intermediate portion and substantially down into said stem lower portion to the bottom of the bore. Radially outer edges of the narrow web members, in the stem intermediate portion, define therebetween the four large rectangular orifices. The large rectangular orifices, lying along a circle passing through the radially outer edges of the narrow web member, occupying at least seventy, and preferably at least seventy-five, per cent of the circumference of the circle. The narrow web members in horizontal cross section preferably take up less than fifty per cent of the available cross-sectional area internal to the stem.

6 Claims, 4 Drawing Sheets

HIGH VOLUME AEROSOL VALVE

FIELD OF THE INVENTION

The present invention relates to an aerosol valve to dispense product from a pressurized container, and more particularly to an aerosol valve having an axially acting high volume discharge stem for discharging a high volume of product and for allowing fast filling of product into the container through the valve stem.

BACKGROUND OF THE INVENTION

In a conventional form of aerosol valve assembly, a vertically acting aerosol valve is opened to release product in the aerosol container by downwardly depressing a button or cap or spout attached to the top of the upstanding valve stem of the aerosol valve. When the button, cap or spout is released, the valve is closed by a spring acting to reseat the valve in a closed position. The valve stem has an annular groove at an intermediate position, with one or more relatively small orifices extending through the valve stem wall at the position of the annular groove. An annular valve sealing gasket with a central opening for the valve stem is positioned in the annular groove, with the orifices being positioned above the lower surface of the valve gasket when the valve is in the closed position. When the valve is opened by pressing the button, etc., the valve stem moves axially downwardly and its one or more orifices will move to a position below the gasket. Product in the aerosol container may then, under the influence of propellant, pass upwardly through the conventional dip tube into the valve housing which surrounds the valve stem, then through the one or more orifices into the valve stem, upwardly through the valve stem bore, and outwardly through an outlet nozzle in the button, cap or spout attached to the top of the valve stem.

It is desirable in certain instances to be able to utilize the above-described conventional aerosol valve to dispense product in large volume at high velocity, for example product in the form of pressurized dusting gas to clean semi-conductor parts, or sprays to attack wasp and hornet nests from a distance, etc. A limitation to date has been due to the need to have sufficient valve stem structure in the area of the annular groove for structural stability, with the valve stem consequently not having sufficient total discharge area in its orifices as well as sufficient available area in the interior of the valve stem itself.

The above-described conventional aerosol valves also may be utilized for filling of product through the valve stem down into the pressurized container for ultimate dispensing back through the valve stem. For fast filling of viscous products, such as shaving gel, it would also be desirable to have sufficient area in the interior of the valve stem as well as sufficient total area in the stem orifices to allow the high speed filling. Such areas have not been available to date for the above-noted structural reasons.

SUMMARY OF THE INVENTION

The present invention is intended to provide a high volume aerosol valve with an axially acting valve stem having upper, intermediate and lower portions. A plurality, preferably four, of large rectangular orifices are provided in an annular groove in the valve stem intermediate portion, the side-to-side vs. top-to-bottom dimensions of the rectangular orifices preferably approximating a ratio of at least about three to one. A bore extends from the top of the valve stem upper portion down through and past the valve stem intermediate portion and substantially down into the stem lower portion. Narrow web cross members have radially outer edges molded integrally with the stem upper and lower portions and occupy the stem bore from a position substantially up into the stem upper portion extending down through the stem intermediate portion and substantially down into the stem lower portion to the bottom of the bore. The radially outer edges of the narrow web members, in the stem intermediate portion, define the plurality of large rectangular orifices in the stem intermediate portion. The plurality of orifices, lying along the circumference of a circle perpendicular to the stem axis and passing through the radially outer edges of the narrow web cross members, occupy at least seventy, and preferably at least seventy-five, per cent of the circumference of the said circle.

It therefore is to be understood that the rectangular orifices in the annular groove take up in large part the circumference of the groove, to thereby provide a total very large discharge (or filling) orifice area. Even with the very large rectangular orifices, the narrow web cross members, the outer edges of which define the large rectangular orifices, provide sufficient structure to prevent stem breakage. This is due to the narrow web cross members extending both substantially up into the stem upper portion and substantially down into the stem lower portion. Yet, the narrow web cross members leave sufficient internal area in the valve stem to allow the desired high volume discharge and rapid filling. Product flow on discharge, or in filling through the stem, accordingly is maximized by the present invention.

The high volume valve stem of the present invention is also simple in structure and is easily molded in one piece of plastic, for example nylon.

Other features and advantages of the present invention will be apparent from the following description, drawings and claims.

DETAILED DESCRIPTION OF EMBODIMENT

Figure 1:
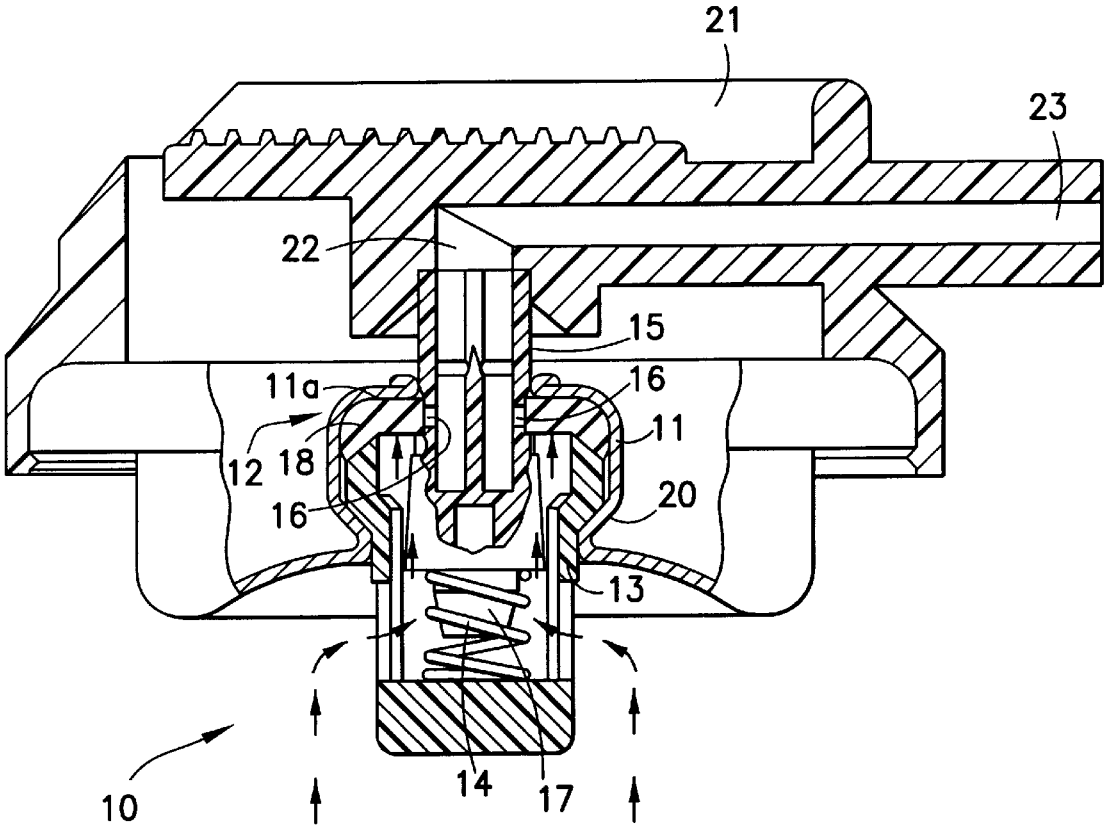
FIG. 1 is an assembly drawing in axial cross section showing the high volume aerosol valve of the present invention in closed position.
Figure 2:
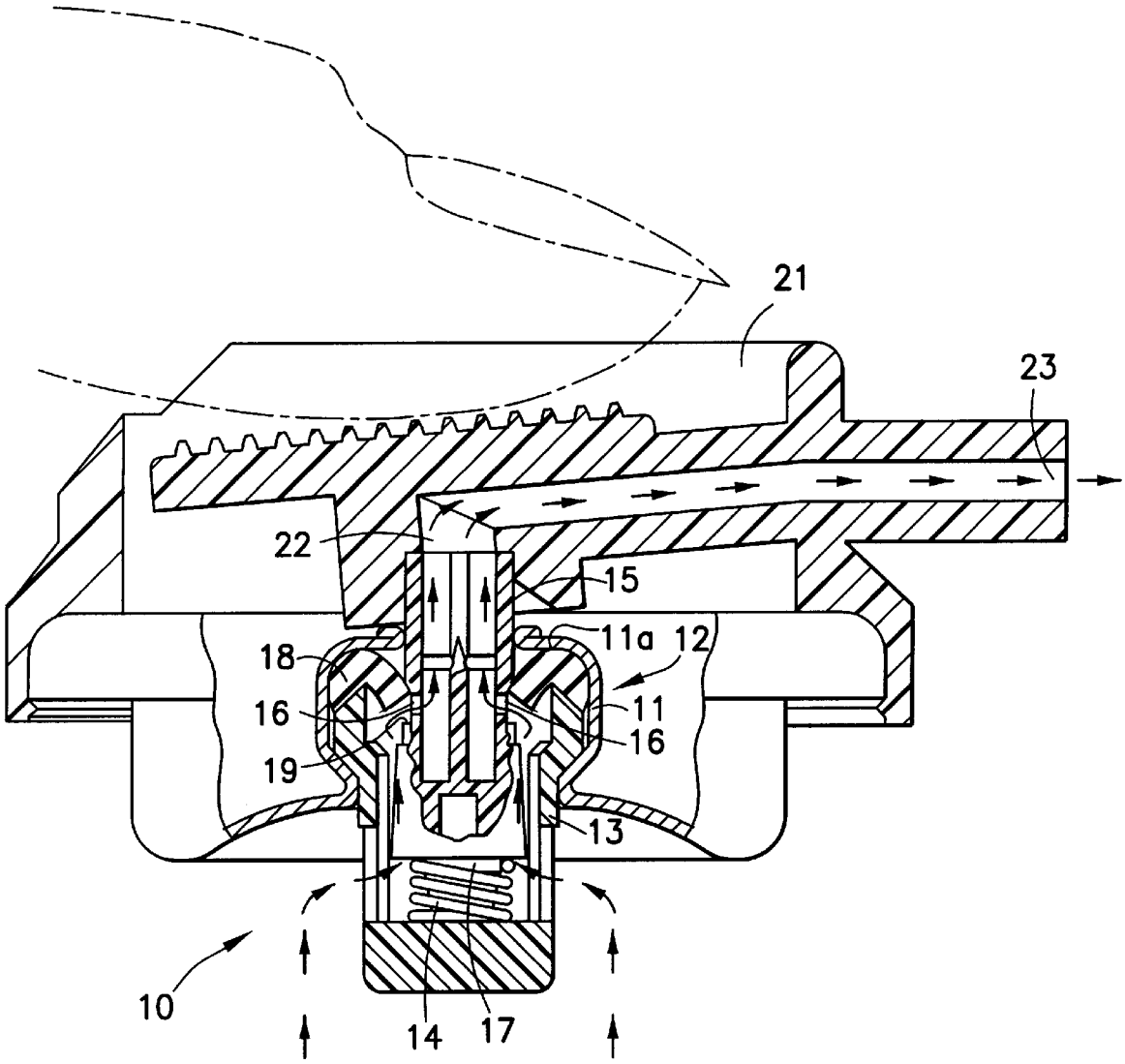
FIG. 2 is an assembly drawing in axial cross section showing the high volume aerosol valve of the present invention in open position.
Figure 3:
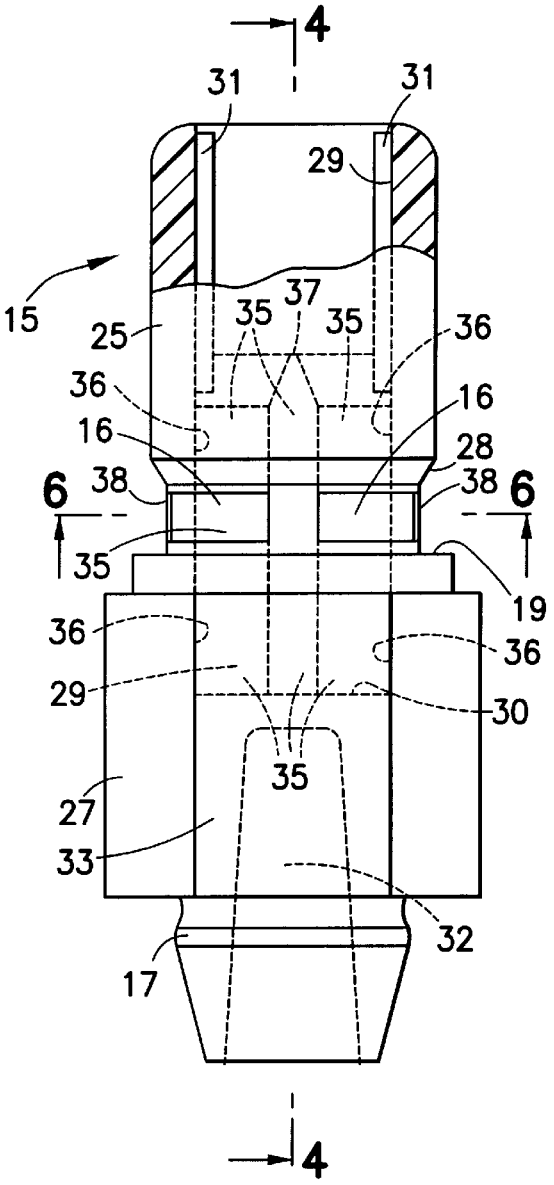
FIG. 3 is a side elevation of the high volume valve stem of the present invention, in partial cross-section.
Figure 4:
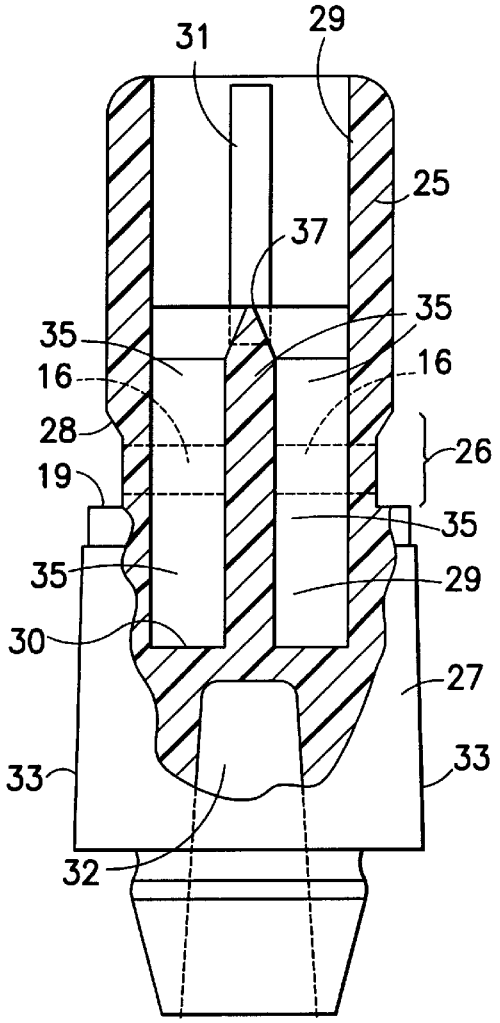
FIG. 4 is a partial axial cross-sectional view of the valve stem, taken along lines 4—4 of FIG. 3.

Referring to FIGS. 1–2, an aerosol valve assembly, designated generally as 10, is fitted and crimped into a pedestal portion 11 of a mounting cup closure 12 for a pressurized container (not shown). The pressurized container holds a propellant and a product to be dispensed, or in some instances relevant to the present invention, solely a propellant for use for example as a dusting gas.

Valve assembly 10 generally includes a valve housing 13, valve closing coil spring 14, and valve stem 15. Valve stem 15 contains lateral orifices 16 entering from the outside of the stem into the interior bore of stem 15. Protrusion 17 extends downwardly from the valve stem 15 and captures and centers the top of coil spring 14.

Resilient annular gasket 18 surrounds valve stem 15 and seals the stem orifices 16 when the aerosol valve is closed (FIG. 1). Annular gasket 18 is clamped between the underside 11*a* of pedestal portion 11 of the mounting cup 12 and an upwardly facing annular ledge 19 on the lower portion of the valve stem 15. The mounting cup is crimped at 20 to retain the aerosol valve assembly.

Attached to the top of valve stem 15 by an annular channel is a conventional actuating spout 21 having an internal product passage 22 in fluid contact with the hollow valve stem 15 and having outlet nozzle 23 for product ejection. When the actuating member 21 is pressed downwardly against the force of spring 14, stem orifices 16 pass below annular gasket 18 (see FIG. 2) and the product within the aerosol container can now pass into the valve housing 13, upwardly around the lower portion of valve stem 15, through the stem orifices 16 into the valve stem 15, upwardly through the hollow stem into the actuating member 21, and outwardly through nozzle 23. When the actuating member 21 is released, the spring 14 urges the valve stem 15 upwardly to the FIG. 1 position where the stem orifices 16 are again blocked by gasket 18. The valve is now closed and product flow is blocked from entering into the valve stem.

The above discussion of FIGS. 1 and 2, in its generality, also applies to conventional aerosol valves with an axially acting valve stem. Now turning to the features of the present invention, FIGS. 3–7 illustrate axially acting high volume discharge stem 15 having upper portion 25, intermediate portion 26 and lower portion 27. Intermediate portion 26 effectively is an annular stem groove defined by frustoconical surface 28 extending inwardly and downwardly from upper stem portion 25, and annular ledge 19 at the top of lower stem portion 27. Intermediate portion 26 contains large rectangular orifices 16 as discussed in further detail below. As previously noted, annular gasket 18 (see FIG. 1) is received within the annular stem groove of stem intermediate portion 26.

Extending from the top of stem upper portion 25 is stem bore 29 which extends down through and past the stem intermediate portion 26 and substantially down into the stem lower portion 27 to bottom 30 of the bore. Anti-nesting vertical ribs 31 are shown positioned in stem upper portion 25. Cup-shaped opening 32 extends well up into stem lower portion 27 to reduce material and also provide for quicker cooling of the valve stem after its molding. Flats 33 on lower stem portion 27 allow product from the container to flow between valve housing 13 and lower stem portion 27.

Narrow vertically extending web cross members 35 are molded within stem bore 29 and occupy stem bore 29 from a position substantially up into stem upper portion 25 extending down through the stem intermediate portion 26 and substantially down into the stem lower portion 27. The narrow web members 35 terminate in a point 37 within the stem upper portion 25, and at the bottom 30 of the bore within stem lower portion 27. Radially outer edges 36 of web members 35 are molded integrally with stem lower portion 27 and stem upper portion 25. In intermediate stem portion 26, radially outer edges 38 of the four web members 35 extend radially further out than edges 36 above and below. Radially outer edges 38 define therebetween the plurality (preferable four, and at least three) of large rectangular orifices 16 in stem intermediate portion 26. It will be noted that the larger rectangular orifices have a side-to-side dimension substantially larger than the top-to-bottom dimension. In a sample embodiment, each large rectangular orifice is 0.080 inches by 0.027 inches, thus approximately three to one in ratio. In a circle drawn normal to the stem axis, passing through the large rectangular orifices 16, and passing through the radially outer edges 38 of the four web members 35, the large rectangular orifices 16 should occupy at least seventy, and preferably at least seventy-five per cent of the circumference of said circle. In the sample embodiment, the said circle has a diameter of 0.140 inches, each radially outward edge 38 has a dimension along the circumference of the circle of 0.025 inches, and thus the large rectangular orifices 16 occupy over seventy-five per cent of the circumference of the circle.

The web members 35, by virtue of extending well above and below intermediate stem portion 26, provide a strong internal stem supporting structure in intermediate portion 26 to insure against stem breakage, despite the fact that the large rectangular orifices 16 take up a large part of the circumference of the intermediate portion 26. The portion of the bore extending down into stem lower portion 27 also provides a reservoir for dirt or product that might otherwise act to accumulate in or above orifices 16.

Figure 5:
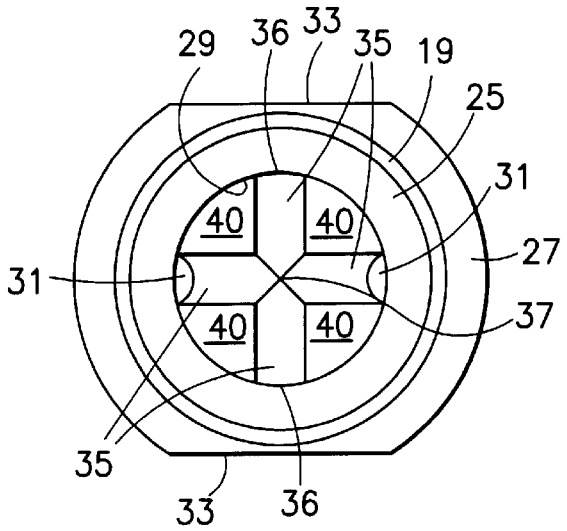
FIG. 5 is a top plan view of the high volume valve stem of the present invention.
Figure 6:
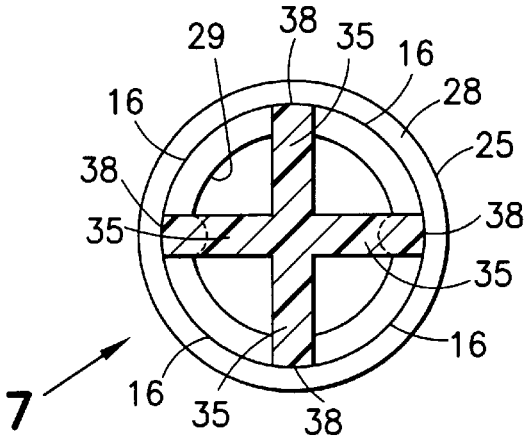
FIG. 6 is a horizontal cross-sectional view of the valve stem, taken along lines 6—6 of FIG. 3.
Figure 7:
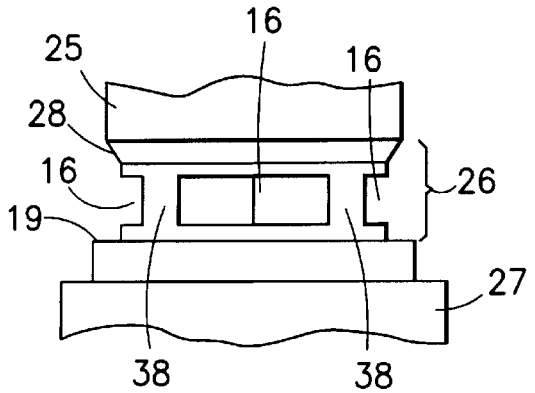
FIG. 7 is a partial side elevational view of the valve stem taken in the direction of arrow 7 in FIG. 6.

The web members 35 of the present invention, by virtue of being very narrow, do not take up excess area internal to the bore 29 of the stem. In the sample embodiment, the web members 35 in horizontal cross section directly above the stem intermediate portion 26 take up less than fifty per cent of the available cross-sectional area internal to the stem. Referring to FIG. 5, the four internal areas in the sample embodiment between the web members 35 are each 0.00116 square inches, with the stem bore being 0.110 inches in diameter.

For the sample embodiment of the present invention, the following nominal dimension of the high volume stem shaft, in addition to the dimensions previously given above, provide a high volume discharge and rapid, through the stem, filling:

Top to bottom dimension of web members 35—0.190 inches.

Width of each web member 35—0.025 inches.

Side to side dimension between diametrically opposite radial outer edges 38 of web members 35—0.140 inches.

Side to side dimension between diametrically opposite radial outer edges 36 of web members 35—0.110 inches.

Outer diameter of stem upper portion 25—0.158 inches.

It will be appreciated by persons skilled in the art that variations and/or modifications may be made to the present invention without departing from the spirit and scope of the invention. It should also be understood that such terms as "upper", "lower", "intermediate", "inner", "outer", "horizontal", "vertical", "top", "bottom", "above", "below" and corresponding similar positional terms as used in the specification, are used and intended in relation to the positions shown in the drawings, and are not otherwise intended to be restrictive.

What is claimed is:

1. A high volume aerosol valve, comprising in combination a mounting cup; an aerosol valve housing captured within the mounting cup; an axially acting valve stem mounted within the said housing, said valve stem having an upper portion extending upwardly and out of the mounting cup, an intermediate portion having a plurality of large rectangular orifices, and a lower portion; the intermediate stem portion having an annular groove therein; an annular gasket surrounding and sealing the intermediate portion of the valve stem including the plurality of large rectangular orifices when the valve stem is not axially depressed; said valve stem having a bore extending from the top of the stem upper portion down through and past the stem intermediate portion and substantially down into the stem lower portion; narrow web members having radially outer edges molded integrally with the stem upper and lower portions and occupying said stem bore from a position substantially up into said stem upper portion extending down through said stem intermediate portion and substantially down into said stem lower portion to the bottom of the bore; the radially outer edges of said narrow web members, in the stem intermediate portion, defining therebetween the plurality of large rectangular orifices in the stem intermediate portion; the large rectangular orifices having a side-to-side dimension substantially larger than the top-to-bottom dimension; the plurality of large rectangular orifices, lying along a circle passing through the radially outer edges of the narrow web members, occupying at least seventy per cent of the circumference of said circle.

2. The invention of claim 1, wherein there are four large rectangular orifices occupying at least seventy-five per cent of the circumference of said circle.

3. The invention of claim 1, wherein the rectangular orifices have a ratio of side-to-side vs. top-to-bottom dimensions of at least approximately three to one.

4. The invention of claim 1, wherein the narrow web members in horizontal cross-section directly above the stem intermediate portion take up less than fifty per cent of the available cross-sectional area internal to the stem.

5. The invention of claim 1, wherein the radial dimension of the narrow web members in the stem upper and lower portions is less than the radial dimension of the narrow web members in the stem intermediate portion.

6. The invention of claim 1, wherein the narrow web members form a cross in horizontal cross-section.

* * * * *